US005243783A

United States Patent [19]

Schmidt et al.

[11] Patent Number: 5,243,783

[45] Date of Patent: Sep. 14, 1993

[54] LOCKING SLIDE BLOCK

[75] Inventors: Melvin J. Schmidt, Lakeland, Minn.; Lawrence J. Ver Steeg, Sioux Falls, S. Dak.

[73] Assignee: Andersen Corporation, Bayport, Minn.

[21] Appl. No.: 903,368

[22] Filed: Jun. 24, 1992

[51] Int. Cl.[5] ..... E05D 15/22

[52] U.S. Cl. ..... 49/181; 49/176

[58] Field of Search ..... 49/161, 181, 176, 177, 49/380, 453, 454, 455; 16/197

[56] References Cited

U.S. PATENT DOCUMENTS

| | | |
|---|---|---|
| 2,720,682 | 10/1955 | Perry . |
| 2,731,287 | 1/1956 | Haynes . |
| 2,883,226 | 4/1959 | Haynes . |
| 3,055,062 | 9/1962 | Peters et al. . |
| 3,195,174 | 7/1965 | Nobes . |
| 3,377,747 | 4/1968 | Donkin . |
| 3,399,490 | 9/1968 | Hettinger . |
| 3,434,236 | 3/1969 | Weidner et al. . |
| 3,524,282 | 8/1970 | Kraft et al. . |
| 3,676,956 | 7/1972 | Taylor et al. . |
| 3,797,168 | 3/1974 | Trout . |
| 3,842,540 | 10/1974 | Anderson . |
| 3,844,066 | 10/1974 | Nobes . |
| 4,068,406 | 1/1978 | Wood . |
| 4,079,549 | 3/1978 | Wood . |
| 4,115,973 | 9/1978 | Anderson . |
| 4,137,671 | 2/1979 | Miller . |
| 4,226,050 | 10/1980 | Kessler . |
| 4,363,190 | 12/1982 | Anderson . |
| 4,364,199 | 12/1982 | Johnson et al. . |
| 4,452,012 | 6/1984 | Deal . |
| 4,590,708 | 5/1986 | Campodonico . |
| 4,610,108 | 9/1986 | Marshik . |
| 4,683,676 | 8/1987 | Sterner, Jr. . |
| 4,718,194 | 1/1988 | FitzGibbon et al. . |
| 4,799,333 | 1/1989 | Westfall et al. . |
| 4,813,180 | 3/1989 | Scalzi . |
| 4,922,657 | 5/1990 | Foss . |
| 4,941,285 | 7/1990 | Westfall . |
| 4,958,462 | 9/1990 | Cross . |
| 5,077,939 | 1/1992 | Erickson . |
| 5,127,192 | 7/1992 | Cross ..... 49/181 |

*Primary Examiner*—Peter M. Cuomo
*Assistant Examiner*—Jerry Redman
*Attorney, Agent, or Firm*—Merchant, Gould, Smith, Edell, Welter & Schmidt

[57] ABSTRACT

The present invention is directed at a locking slide block for slidably and pivotally mounting a window sash to a side member of a window frame having a vertical jamb channel. The window pivot has a housing with oppositely disposed sliding surfaces for guiding the housing in the jamb channel. Operably connected to the housing is a locking spring for selectively engaging the jamb channel and locking the housing in a fixed position. A sash pivot is operably connected to the sash and to the housing. The housing also has a sash pivot retainer spring. The pivot and housing have flanges to prevent the pivot from being pulled away from the housing proximately parallel to the longitudinal axis of an elongated portion of the pivot.

5 Claims, 3 Drawing Sheets

FIG. 1
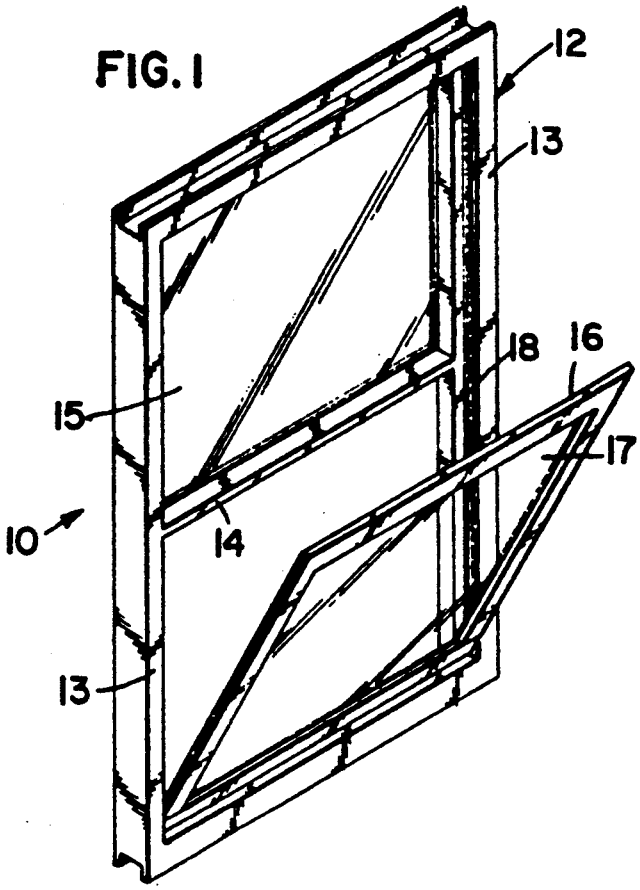
FIG. 3
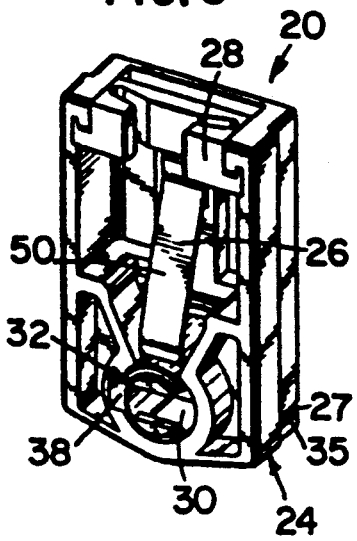
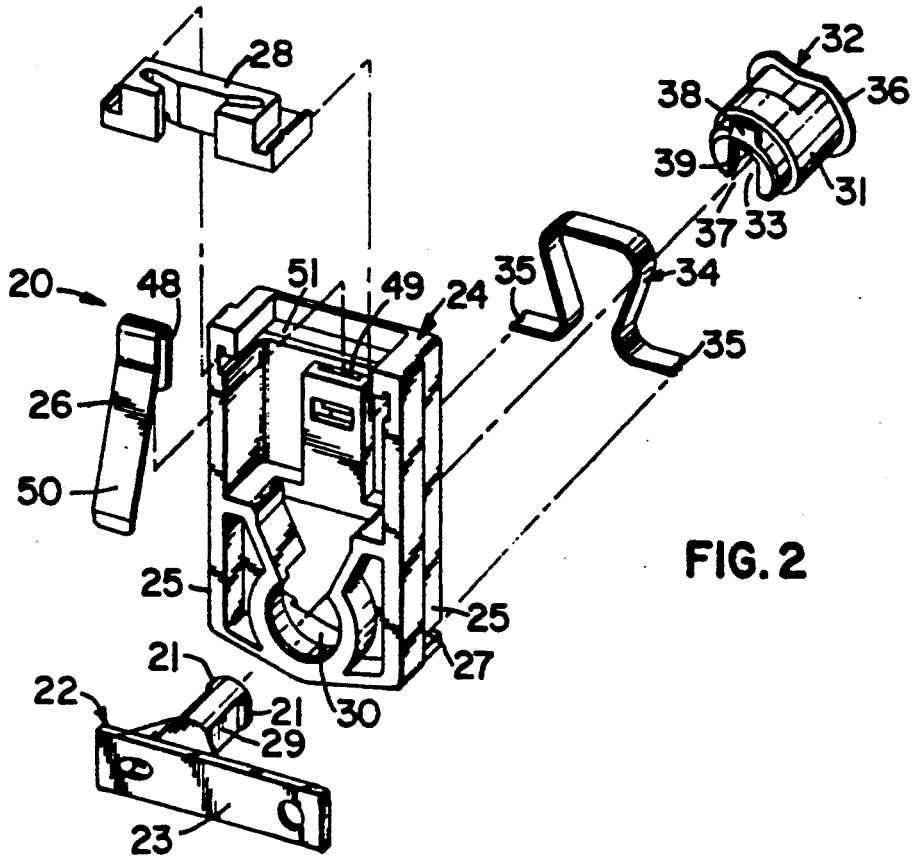
FIG. 2

LOCKING SLIDE BLOCK

FIELD OF THE INVENTION

This invention generally relates a locking slide block for double-hung tilt-out type windows.

BACKGROUND OF THE INVENTION

Double-hung, tilt-out type windows have become increasingly popular. Much of this popularity is due to the tilt-out feature which allows both inside and outside surfaces of the window to be cleaned from the inside.

Tilt-out windows have been equipped with locking slide blocks such as the one disclosed in U.S. Pat. No. 4,610,108 to Marshik. Marshik discloses a double-hung window having a frame with a set of parallel jamb channels on opposite sides of the frame. Within each jamb channel is a slidably mounted locking block. A spring counter-balance mechanism is attached to a headplate on each block. A pivot extends from proximate the lower end of opposite sides of a sash into a locking cam housed within the block. The pivots allow the sash, which holds a window pane, to be rotated or tilted toward the inside. As the pivots rotate, the cam forces serrated ends of a spring into opposite sides of the jamb channel to prevent the counter-balance spring from pulling up the blocks and sash while cleaning.

U.S. Pat. No. 4,813,180 to Scalzi discloses another locking sliding block for double-hung windows. Like the '108 patent, a locking block is slidably mounted within jamb channels and a pivot extends from opposite sides of the sash into a pivot button or cam in each locking block. Unlike the '108 patent, however, the pivot has a slot which engages a retaining ridge in the pivot button. This is intended to prevent dislocation of the pivots during transport and installation of the window due to deflection or bowing of the frame away from the sash. The locking block disclosed by Scalzi, although allowing the sash to pivot inside for easy cleaning of the window pane, does not allow the window to be conveniently removed from the inside.

SUMMARY OF THE INVENTION

The present invention is a locking slide block for slidably and pivotally mounting a window sash to a side member of a window frame having a vertical jamb channel with oppositely disposed sides. The block has a housing with oppositely disposed sliding surfaces for guiding the housing in the jamb channel. Within the block is a blocking spring with serrated ends for selectively engaging the oppositely disposed side of the jamb channel to lock the block in a fixed position. A rotary cam, having a rotational axis, is carried within the housing of the block. The cam has camming surfaces which come into contact with the locking spring to force the serrated ends of the locking spring into engagement with the sides of the jamb channel.

One sash pivot is disposed on each lower opposite side of the sash for operatively connecting the sash to the cam. The pivot has a longitudinal axis. Proximate one end of each pivot are oppositely disposed flanges extending perpendicularly away from the longitudinal axis. The cam has a sash pivot opening with an open top slot for inserting or removing the sash pivot. The cam also has oppositely disposed flanges extending perpendicularly to the cam's rotational axis into the sash pivot opening. When the pivot is in the pivot opening of the cam, the pivot flanges engage the cam flanges so that the pivot cannot be pulled out of the pivot opening in a direction proximately parallel to the longitudinal axis of the pivot.

The locking slide block also has a sash pivot retainer spring having a first end operatively connected to the housing and a free second end proximate the cam. The spring has a depressible first position for allowing the sash pivot to be inserted or removed from the sash pivot opening through the open top slot. The spring also has a second and normal position for preventing removal of the sash pivot through the open top slot.

These advantages and other objectives obtained with this invention are further explained hereinafter with more particularity and by reference to the preferred embodiment as shown in the following drawings.

BRIEF DESCRIPTION OF THE DRAWINGS

FIG. 1 shows a double-hung window with a partially tilted sash;

FIG. 2 shows an exploded perspective view of a locking slide block with pivot in accordance with the present invention;

FIG. 3 shows an assembled locking slide block without pivot in accordance with the present invention;

DETAILED DESCRIPTION OF THE PREFERRED EMBODIMENT

Figure 5:
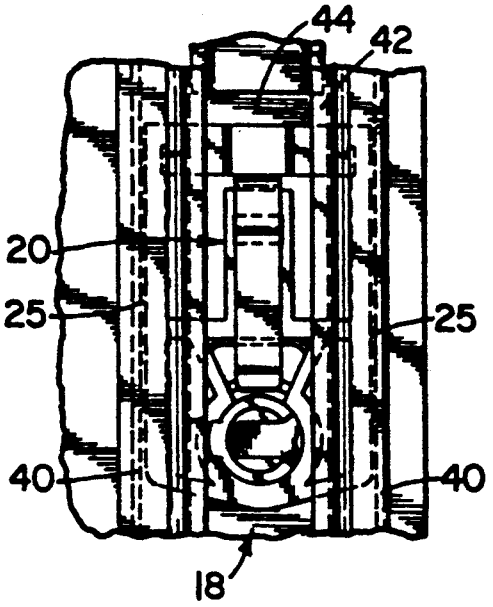
FIG. 5 shows a locking slide block unlocked in a jamb channel.

Referring now to the drawing, wherein like referenced numerals designate identical or corresponding parts throughout the several views, FIG. 1 shows a double-hung tilt-out window 10. The window 10 has a frame 12 and an upper sash 14 and lower sash 16 supporting window panes 15 and 17, respectively. The frame 12 also has four plastic jamb channels 18, one of which is shown in FIG. 1, on a side member 13 of frame 12. One jamb channel 18 is proximate opposite sides of the upper sash 14 and lower sash 16. As shown in FIG. 1, the lower sash 16 is partially tilted so that both sides of the window pane 17, within the lower sash 16 are accessible for cleaning from the same side of window 10.

FIG. 2 shows an exploded view of a sliding locking block, generally referred to as 20, and sash pivot 22 of the present invention. One sliding locking block 20 is slidably mounted within each jamb channel 18. Fastened to lower opposite sides of each sash 14 and 16 is one pivot 22. These pivots 22 are supported for rotation by the sliding locking blocks 20. Each sash is tiltable about a longitudinal axis through pivots 22 disposed on opposite sides of sashes 14 and 16.

As shown in FIG. 2, sliding locking block 20 has a housing 24, preferably of rigid plastic. This housing 24 has sliding surfaces 25 with slots 27. The housing 24 has an aperture 49 and a plate groove 51 for attaching a sash pivot retainer spring 26 and a metal plate 28, respectively. A counterbalance spring (not shown) is attached to metal plate 28. The housing 24 has a circular channel 30 for receiving a locking cam 32 having camming surfaces 31. Housing 24 also has a box-like area for receiving locking spring 34 which has serrated end portions 35. Locking cam 32 has a head 36 which, as known to those skill in the art, retains spring 34 in the box-like area of housing 24.

Sash pivot retainer spring 26, as shown in FIG. 2, has a hooked first end 48 which is received by aperture 49 to operably connect retainer spring 26 to housing 24. Retainer spring 26 also has a free end 50. Retainer spring 26 is preferably spring steel.

The locking cam 32, as shown in FIG. 2, has a sash pivot opening 33 with an open top slot 37. Located proximate a front side of locking cam 32, on opposite sides of sash pivot opening 33 are inwardly disposed cam flanges 39.

FIG. 3 shows a perspective view of the assembled sliding locking block 20 without pivot 22. Retainer spring 26 and plate 28 are shown installed within housing 24. Free end 50 of spring 26 is in a normal position proximate the front side of locking cam 32. Locking cam 32 is shown inserted within circular channel 30, and is retained within block 20 by a tab 38. FIG. 3 also shows one serrated end portion 35 of spring 34 retracted within slot 27 in sliding surface 25.

Figure 4:
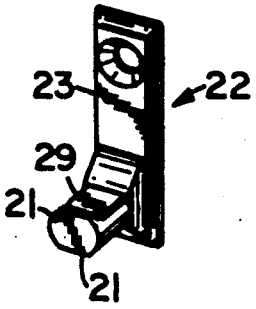
FIG. 4 shows a perspective view of the sash pivot.

FIG. 4 is a front view of pivot 22 having oppositely disposed flanges 21 at one end of an elongated portion 29, and a back 23. Pivots 22 are fastened to the lower opposite sides of sashes 14 and 16 so that the lengthwise axis of back 23 is parallel to the lengthwise axis of the sash side.

FIG. 5 shows sliding locking block 20 inserted in jamb channel 18 having sides 40. Sliding surfaces 25 of sliding locking block 20 are proximate side 40 of jamb channel 18. Sliding locking block 20 is held within jamb channel 18 by a flexible raised jamb channel face 42 having opening 44.

Figure 6:
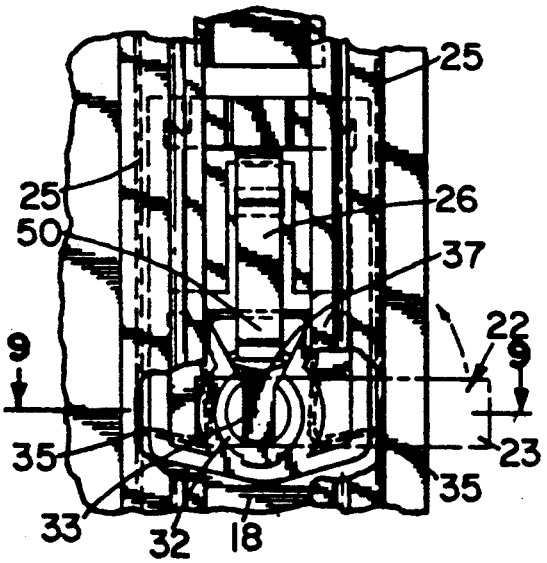
FIG. 6 shows a locking slide block in the locked position in a jamb channel.

As shown in FIG. 6, the serrated portions of spring 34 are engaged with sliding surfaces 25 to prevent the counterbalance spring from pulling sliding locking block 20 and sash 14 or 16 upward when sash 14 or 16, respectively are tilted. When sash 14 or 16 and, thus back 23, is rotated from vertical, locking cam 32 rotates so that camming surfaces 31 force serrated end portion 35 of spring 34 out slots 27. In FIG. 6, back 23 is tilted to a horizontal position at approximately 90° to jamb channel 18. This position also corresponds to sash 14 or 16 tilted at 90° to jamb channel 18.

Also shown in FIG. 6, pivot 22 is operably connected to locking cam 32 by rotating cam 32 (by a tool not shown) so that open top slot 37 opens upward beneath retainer spring 26. Pivot 22 is inserted into sash pivot opening 33 by depressing the free end 50 of retainer spring 26 from the normal position inwardly away from the front side of locking cam 32. After pivot 22 is inserted in sash pivot opening 33, the free end of retainer spring 26 moves back to the normal position over opening 33. Once retainer spring 26 moves back over opening 33, pivot 22 cannot slip out of opening 33. Without retainer spring 26, pivot 22 might slip out of opening 33 when sash 14 or 16 is tilted.

Figure 9:
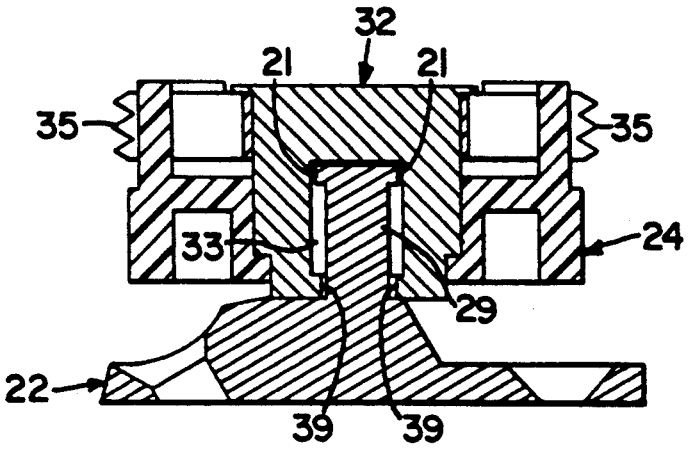
FIG. 9 shows a cross-section of the locking slide block.

As best shown in FIG. 9, a cross-sectional view of cam 32 and pivot 22 taken from FIG. 6, when pivot 22 is inserted into sash pivot opening 33, the elongated portion 29 extends into the opening beyond cam flanges 39. Flanges 21 of pivot 22 are disposed widely enough that when pivot 22 is inserted in this manner, flanges 21 engage with cam flanges 39 so that pivot 22 cannot be pulled out of the pivot opening in a direction proximately parallel to a longitudinal axis of the elongated portion 29. This feature is particularly important during transport and installation of window 10. During transport and installation, side members 13 of frame 12 may bow outwardly away from sashes 14 and/or 16 so that without the engagement of flanges 21 with cam flanges 39, elongated portion 29 of pivot 22 could be pulled out of sash pivot opening 33.

Figure 7:
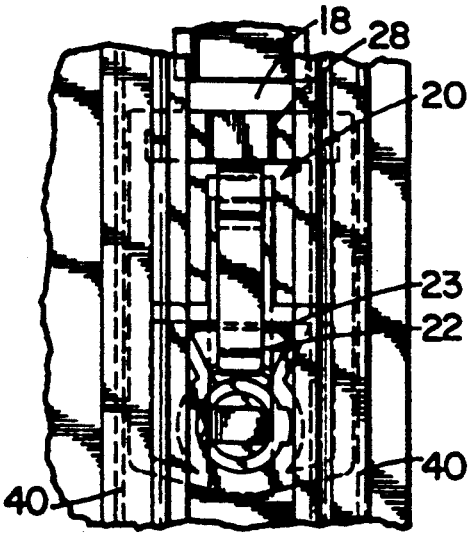
FIG. 7 shows a mirror image of the locking slide block of FIG. 5.

FIG. 7 shows back 23 of pivot 22 oriented vertically. This position of back 23 corresponds to the closed or vertical position of sash 14 or 16. Serrated end portions 35 of spring 34 are not engaged with sides 40 of jamb channel 18. Sliding lock block 20 and sash 14 or 16 is thus free to slide vertically within jamb channel 18. The counterbalance spring (not shown) attached to plate 28 assists in sliding locking blocks 20 and sashes 14 or 18 upward in jamb channels 18.

Figure 8:
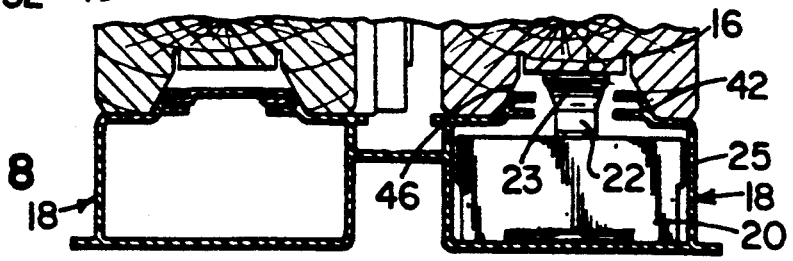
FIG. 8 shows parallel jamb channels, one with a counterbalance spring cover and the other having a locking slide block with pivot.

FIG. 8 shows a cross-sectional view of parallel jamb channels 18. In one of the jamb channels 18 is shown sliding locking block 20 without serrated end portions 35 of spring 34 extending beyond sides 25 of sliding locking block 20. As previously shown in FIG. 7, back 23 of pivot 22 is positioned vertically. Flexible jamb channel face 42 is engaged with a sash grove 46 to retain sash 16 vertically within frame 12 (not shown).

Although characteristics and advantages, together with details of structure and function, have been described in reference to the preferred embodiment herein, it is understood that the disclosure is illustrative. To that degree, various changes made, especially in matters of shape, size and arrangement, to the full extent extended by the general meaning of the terms in which the appended claims are expressed, are within the principal of the present invention.

What is claimed is:

1. A locking slide block for slidably and pivotally mounting a window sash to a side member of a window frame having a vertical jamb channel, the slide block comprising:

(a) a housing having oppositely disposed sliding surfaces for guiding the housing in the jamb channel;

(b) locking means adapted for selectively engaging the jamb channel and locking the block in a fixed position;

(c) a cam carried in the housing, the cam having camming surfaces to come in contact with the locking means to operate the locking means;

(d) a sash pivot, the pivot operatively connected to the sash and to the cam;

(e) the cam having a sash pivot opening, the opening having an open top slot; and (f) a sash pivot retainer spring, the spring having a first end operatively connected to the housing and a free second end proximate the sash pivot opening, the second end having a depressible, first position for allowing the sash pivot to be inserted or removed from the sash pivot opening through the open top slot and a normal, second position at least partially covering the open top slot for preventing removal of the sash pivot through the open top slot.

2. A locking slide block in accordance with claim 1, wherein the locking means is a locking spring having oppositely disposed serrated end positions.

3. A locking slide block in accordance in claim 1, comprising a plate for attaching a counterbalance spring.

4. A locking slide block for slidably and pivotally mounting a window sash to a side member of a window frame having a vertical jamb channel, the slide block comprising:

(a) a housing defining oppositely disposed sliding surfaces for guiding the housing in the jamb channel;

(b) locking means adapted for selectively engaging the jamb channel and locking the block in a fixed position;

(c) a cam carried in the housing, the cam having camming surfaces to come to contact with the locking means to operate the locking means;

(d) a sash pivot, having a longitudinal axis, the pivot operatively connected to the sash and to the cam, the sash pivot having two flanges, at one end of an elongated portion of the pivot, oppositely and outwardly disposed from the longitudinal axis of the pivot;

(e) the cam having a sash pivot opening, the opening having an open top slot;

(f) the open top slot defined by a bottom a first side and a second side, the sides each having a cam flange; so that the elongated portion of the pivot can be inserted into the open top slot, and the flanges of the pivot engage with the cam flanges to prevent the pivot from being pulled out of the pivot opening in a direction approximately parallel to the longitudinal axis of the elongated portion of the pivot; and (g) a sash pivot retainer spring, the spring having a first end operably connected to the housing and a free second end proximate the sash pivot opening, the second end having a depressible, first position for allowing the sash pivot to be inserted or removed from the sash pivot opening through the open top slot and a normal, second position at least partially covering the open top slot for preventing removal of the sash pivot through the open top slot.

5. A locking slide block in accordance with claim 4, wherein the locking means is a locking spring having oppositely disposed serrated end portions.

* * * * *